US006854457B2

(12) United States Patent
Rabas et al.

(10) Patent No.: US 6,854,457 B2
(45) Date of Patent: Feb. 15, 2005

(54) CONVECTION OVEN AND RELATED COOKING AIR FLOW SYSTEM

(75) Inventors: Jiri Rabas, Federal Way, WA (US); Paula Schmitz, Edgewood, WA (US); Nigel Mills, Kettering, OH (US)

(73) Assignee: Premark FEG L.L.C., Wilmington, DE (US)

( * ) Notice: Subject to any disclaimer, the term of this patent is extended or adjusted under 35 U.S.C. 154(b) by 0 days.

(21) Appl. No.: 10/413,839

(22) Filed: Apr. 15, 2003

(65) Prior Publication Data

US 2003/0172919 A1 Sep. 18, 2003

(51) Int. Cl.[7] ..... A21B 1/08; F24C 15/32

(52) U.S. Cl. ..... 126/21 A; 126/21 R; 126/20; 99/476

(58) Field of Search ..... 126/21 R, 21 A, 126/20; 99/476, 474, 477; 34/191; 219/400, 401

(56) References Cited

U.S. PATENT DOCUMENTS

| | | | | |
|---|---|---|---|---|
| 1,536,427 A | | 5/1925 | Degner | |
| 1,852,526 A | | 4/1932 | Kemp | |
| 1,857,447 A | | 5/1932 | Engels | |
| 1,878,519 A | | 9/1932 | Hoppe | |
| 2,351,487 A | | 6/1944 | Cooney | |
| 2,384,390 A | | 9/1945 | Nalbach et al. | |
| 2,767,667 A | | 10/1956 | Spooner | |
| 3,148,674 A | | 9/1964 | Boardman et al. | |
| 3,537,405 A | | 11/1970 | Verhoeven | |
| 3,905,760 A | | 9/1975 | Johansson et al. | |
| 3,926,106 A | | 12/1975 | Deusing et al. | |
| 3,954,053 A | | 5/1976 | Johansson et al. | |
| 4,029,463 A | | 6/1977 | Johansson et al. | |
| 4,202,259 A | | 5/1980 | Johansson | |
| 4,357,522 A | | 11/1982 | Husslein et al. | |
| 4,381,442 A | | 4/1983 | Guibert | |
| 4,492,216 A | | 1/1985 | Dumont | |
| 4,515,143 A | | 5/1985 | Jabas | |
| 4,627,409 A | | 12/1986 | Kagomoto | |
| 4,648,377 A | | 3/1987 | Van Camp | |
| 4,779,604 A | | 10/1988 | König | |
| 4,782,214 A | | 11/1988 | Voegtlin | |
| 4,813,398 A | | 3/1989 | Savage | |
| 4,823,766 A | | 4/1989 | Violi | |
| 4,869,155 A | | 9/1989 | Grieve | |
| 4,909,236 A | | 3/1990 | Del Fabbro | |
| 4,975,047 A | | 12/1990 | Mitsuhashi et al. | |
| 5,014,679 A | | 5/1991 | Childs et al. | |
| 5,080,087 A | * | 1/1992 | McFadden et al. | 126/21 A |
| 5,129,384 A | | 7/1992 | Parks | |
| 5,394,791 A | | 3/1995 | Vallee | |
| 5,429,112 A | | 7/1995 | Rozzi | |
| 5,441,405 A | | 8/1995 | Bedford et al. | |
| 5,556,566 A | | 9/1996 | Cappello et al. | |
| 5,615,603 A | | 4/1997 | Polin | |
| 5,617,839 A | | 4/1997 | Jennings et al. | |
| 5,717,192 A | | 2/1998 | Dobie et al. | |
| 5,814,789 A | | 9/1998 | O'Leary et al. | |
| 5,845,631 A | * | 12/1998 | Kleva et al. | 126/21 A |
| 6,021,709 A | | 2/2000 | Koopman et al. | |
| 6,121,582 A | | 9/2000 | Dollinger et al. | |
| 6,557,543 B2 | * | 5/2003 | Cole et al. | 126/21 A |

OTHER PUBLICATIONS

Adamatic Hobart Service Manual—Rack Ovens—67 pages—Sep. 1989.

Hobart Food Equipment Flier—HO300G Mini Rotating Rack Oven—Gas—Features, Options, Specifications—2 pages—Apr. 2001.

Baxter Flier—OV300G Gas Mini Rotating Oven Rack—Features, Specifications—2 pages—May 2001.

Hobart Food Equipment Flier—HSRO Single Rack Gas Oven—Options, Specifications, Details, Dimensions—2 pages—May 1997.

* cited by examiner

*Primary Examiner*—James C. Yeung
(74) *Attorney, Agent, or Firm*—Thompson Hine LLP

(57) ABSTRACT

A rack oven includes a cooking air flow path that, in one embodiment, is generally horizontal and/or that flows along an axial length of a plurality of heat exchange tubes. Air flow may be driven by a plurality of vertically spaced axial fans.

32 Claims, 7 Drawing Sheets

CONVECTION OVEN AND RELATED COOKING AIR FLOW SYSTEM

TECHNICAL FIELD

The present invention relates generally to convection ovens used for baking items such as bread and, more particularly, to a rack type convection oven having a substantially horizontal air flow path from heat exchanger to baking chamber and back to heat exchanger, and to a rack type oven in which air flows along an axial length of heat exchange tubes of a heat exchanger.

BACKGROUND

Rack ovens are generally equipped with a fuel-fed heating element and a fan for moving heated air throughout a baking chamber to provide a rapid distribution of hot air over the food product. Commercial ovens of this type include a baking chamber, which is sized to receive a rack having multiple shelves containing products to be baked; a power driven, rotating mechanism to rotate the product as it is being cooked or baked; a heat exchanger including one or more gas burners and an exhaust system to eliminate combustion gases; and a circulating system for directing hot air along a heated air flow path that passes through the baking chamber. Conventional rack ovens of the type for baking bread also generally include a steam generator for the introduction of steam into the oven for brief periods of time, usually at the beginning of the baking process, to impart a desired appearance to the baked food product.

In convection ovens such as that described in U.S. Pat. No. 5,617,839, a rack oven includes a heat exchanger comprising a plurality of heat exchange tubes, and a plurality of gas fired in-shot burners, wherein each of the in-shot burners fires into a corresponding heat exchange tube. One or more blowers circulate air past the heat exchange tubes and to the oven baking chamber. The input openings of the plurality of heat exchange tubes are arranged in a plurality of horizontal rows, each row containing a plurality of input openings, the rows spaced vertically from each other. Each tube then extends across an air flow region into a vertical gas collection duct, with corresponding tubes then extending back across the air flow region to another gas collection duct and so on. It is also known to provide heat exchange tubes having appropriate bends. In either case, the air flow of the oven is generally upward across the heat exchange tubes, over the top of the baking chamber in a plenum, downward and into the baking chamber through distribution ports in a wall of the chamber, then out of the baking chamber and back upward through the heat exchanger.

FIGS. 7A and 7B illustrate another PRIOR ART rack oven construction 100 in which a heat exchanger section 102 is positioned alongside the baking chamber 104. The wall 106 separating the baking chamber 104 from the heat exchanger section 102 includes a single, centrally disposed opening 108 having an axial fan 109 positioned therein. The wall 106 also includes louvers 110 towards the sides thereof. The heat exchanger section 102 includes a plurality of horizontally extending, U-shaped exchange tubes 112, with tube segments 120 and 122, are arranged vertically one above the other. When the fan 109 is rotated, air flows from the baking chamber 104, through the opening 108 onto a central section of the heat exchange tubes and then splits in two lateral directions along the heat exchange tubes to be returned to the baking chamber via louvers 110 as best seen by the arrows in FIG. 7A. As best reflected in FIG. 7B, there is also a substantial vertical (upward and downward) component to the air flow in the heat exchanger section 102 due the central location of the opening 108. Likewise, there would be a significant vertical component to the air flow in the baking chamber 104 as well. A steam generator (not shown) is also provided in the prior art oven 100. As best seen in FIG. 7C, the U-shaped heat exchange tubes 112 are arranged at progressively increasing angles to the horizontal when moving away (either upward or downward) from a vertically central location 124 of the tubes.

SUMMARY

In one aspect, a rack oven includes a baking chamber, a door providing access to the baking chamber and a steam generator for providing moisture-containing air to the baking chamber. A heat exchanger section is positioned outside the baking chamber and alongside a first wall of the baking chamber. At least one air outlet is positioned in a first corner of the baking chamber and in flow communication with the heat exchanger section, the first corner adjacent the first side of the baking chamber. At least one air inlet is positioned in a second corner of the baking chamber and in flow communication with the heat exchanger section. At least one blower is positioned to circulate air through the oven, when the blower is operated air flows generally horizontally through the heat exchanger section, through the air inlet into the baking chamber, generally horizontally through the baking chamber, and through the air outlet back into the heat exchanger section.

In another aspect, an oven includes a baking chamber, a door providing access to the baking chamber, a plurality of in-shot burners and a heat exchanger section positioned outside the baking chamber, the heat exchanger section comprising a plurality of heat exchange tubes. Each in-shot burner of the plurality of in-shot burners is aligned for firing into a respective one of the heat exchange tubes. An air outlet is provided for passing air out of the baking chamber, with an air outlet flow path extending from the air outlet to the heat exchanger section and introducing air into the heat exchanger section toward a first axial side of the plurality of heat exchange tubes. An air inlet is provided for passing air into the baking chamber, with an air inlet flow path extending from the heat exchanger section to the air inlet causing air to exit the heat exchanger section toward a second axial side of the plurality of heat exchange tubes. At least one blower is positioned for circulating air through the heat exchanger section, through the air inlet into the baking chamber, and through the air outlet back into the heat exchanger section, whereby air flows through the heat exchanger section from the first axial side to the second axial side.

In a further aspect, an oven includes a baking chamber, a door providing access to the baking chamber and a heat exchanger section positioned outside the baking chamber. A plurality of vertically spaced air outlet openings are located in a baking chamber wall, each opening aligned with a respective, adjacent axial fan, the openings in flow communication with the heat exchanger section. A plurality of air inlet openings are provided in a baking chamber wall and in flow communication with the heat exchanger section for passing heated air from the heat exchanger section to the baking chamber. When the axial fans are operated air flows generally horizontally through the heat exchanger section, through the air inlet into the baking chamber, generally horizontally through the baking chamber, and through the air outlet openings and back into the heat exchanger section.

In yet another aspect, a method is provided in connection with a rack oven including a baking chamber for baking food products, a heat exchanger section having a plurality of heat exchange tubes with a corresponding plurality of in-shot burners aligned therewith for firing into the tubes and at least one blower for moving air from the baking chamber, through the heat exchanger section and back to the baking chamber. The method includes the steps of: firing the plurality of in-shot burners; introducing air from the baking chamber into the heat exchanger section toward a first axial side of the heat exchange tubes; moving the air from the first axial side along the axial length of the heat exchange tubes toward the second axial side; and returning air from the heat exchanger section to the baking chamber after the air has moved along the axial length of the heat exchange tubes toward the second axial side to pick up heat from the heat exchange tubes.

DETAILED DESCRIPTION

In a typical operation of a convection oven containing a steam generator, the oven is pre-heated to a predetermined temperature for a period of time to allow the steam generator to reach a peak temperature for vaporizing water into steam. The bread or other goods to be baked are loaded onto a wheeled rack and placed in the oven chamber and the oven door is closed. The rack is then lifted off the floor by a lifting device and begins to rotate at a set speed. The steaming process is started by spraying water over the heat accumulating units to produce steam uniformly over the total height of the steam generator. The steam produced infiltrates the entire oven and condenses on the cool surface of the unbaked bread or other goods. At the end of the predetermined steaming period (usually about 10 to 30 seconds), the flow of water to the steam generator is discontinued as bake cycle continues. Prior to baking, a substantial portion of the steam may be exhausted from the baking chamber through a vent opening. During the bake period a fan continuously circulates the heated air throughout the entire system. For additional batches, the procedure is repeated except that it is generally not necessary to pre-heat the oven since the previous baking cycle provides sufficient heat.

Figure 1:
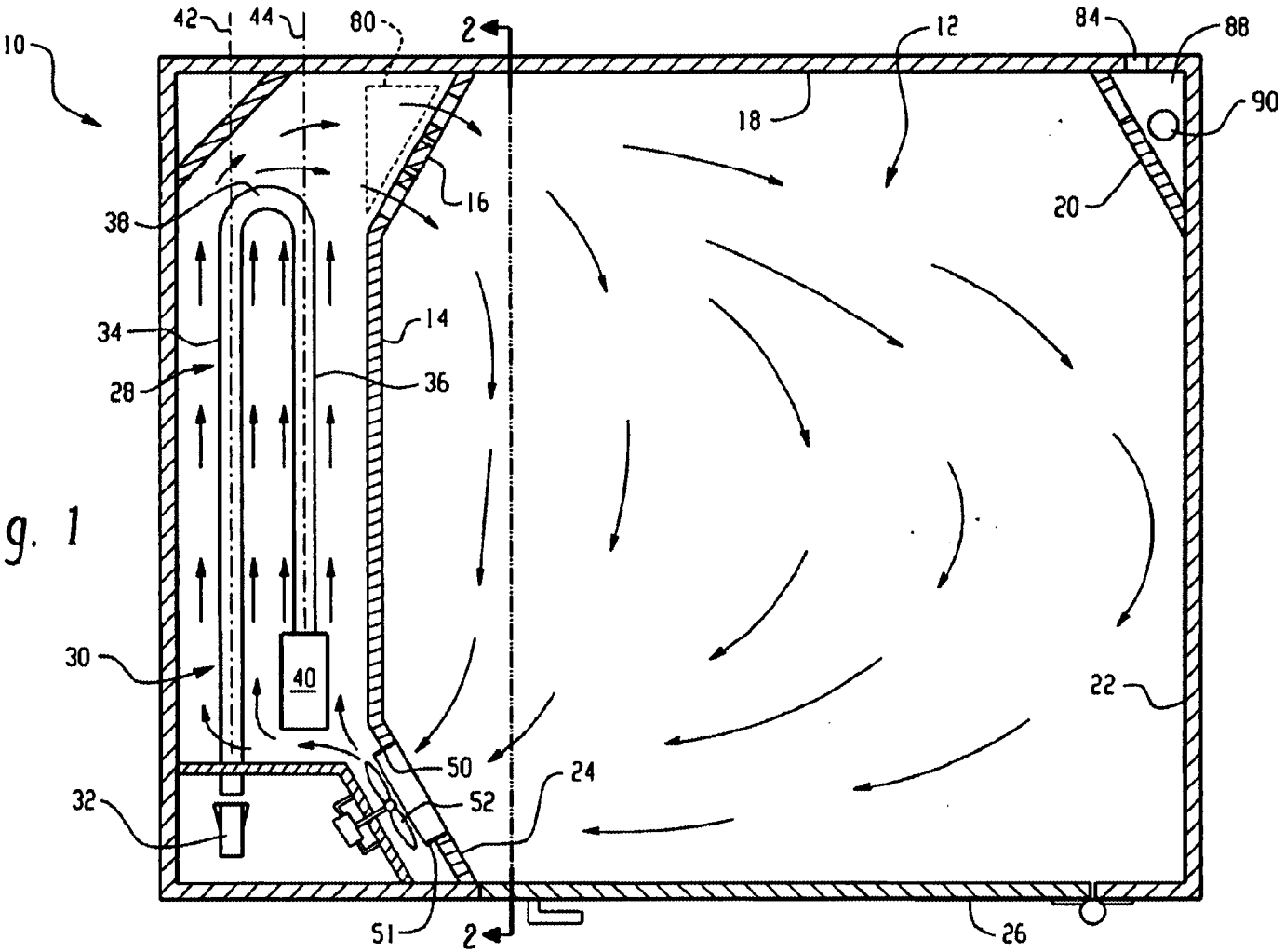
FIG. 1 is a top plan view of a rack oven layout.

Referring to the top view of FIG. 1, a rack oven 10 includes a baking chamber 12 defined by wall panels 14, 16, 18, 20, 22 and 24, and a door 26 which can be opened to provide access to the chamber 12. A heat exchanger section 28 of the oven is located outside the baking chamber 12 and alongside side wall 14 of the baking chamber. The heat exchanger section 28 includes a plurality of heat exchange tubes 30 spaced apart vertically, with a corresponding plurality of in-shot burners 32 each aligned for firing into a respective one of the heat exchange tubes. In the illustrated embodiment the heat exchange tubes 30 include tube sections 34 and 36 connected by a bend 38. The end of each tube section 36 terminates in a vertical duct 40 to vent the exhaust gases of combustion. Axes 42 and 44 of respective tube sections 34 and 36 are shown, and the tube sections extend parallel with each other. The oven 10 may be a single integrated unit or may be formed by modules connected together, such as a baking chamber module and a heat exchanger module.

Figure 2:
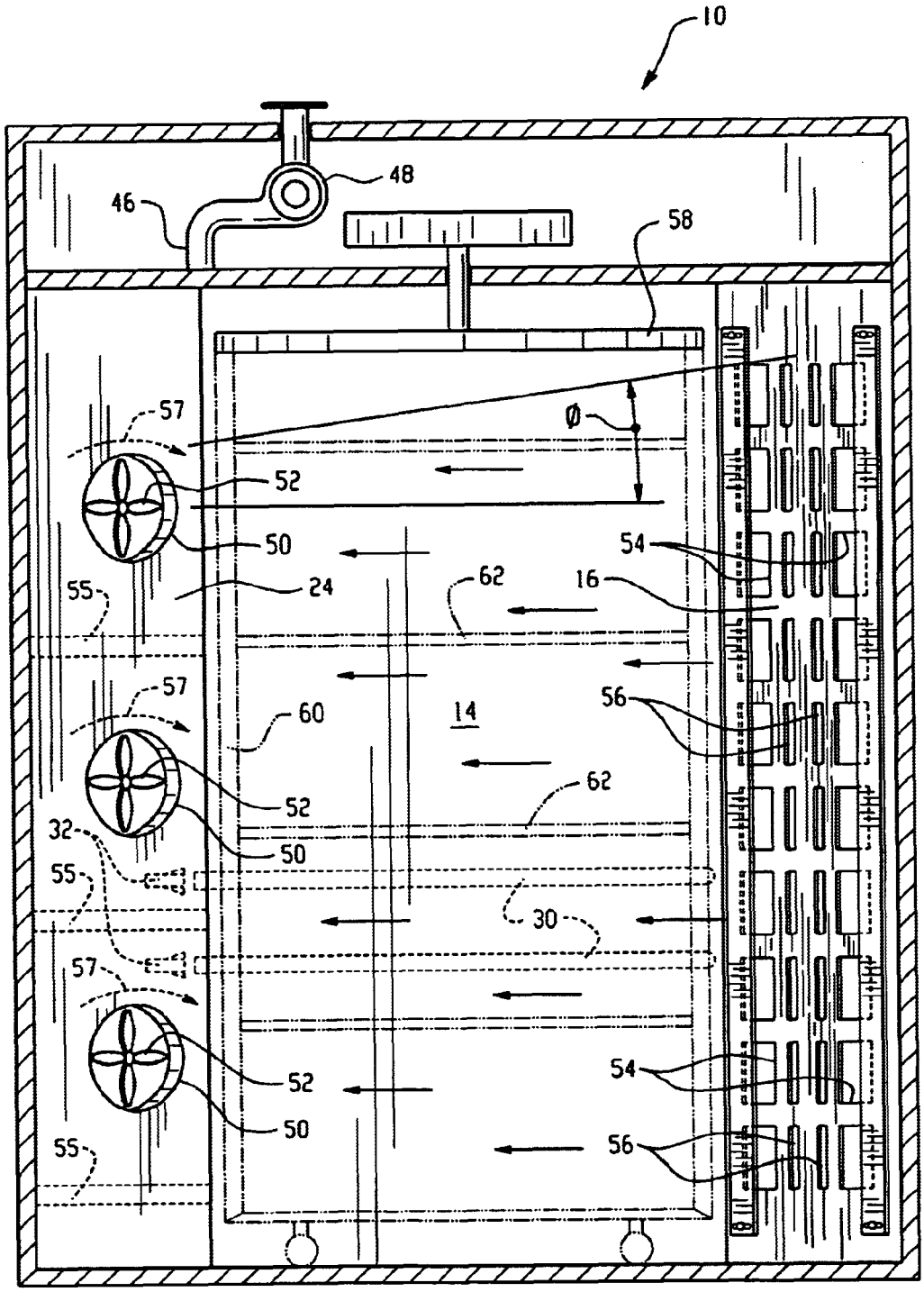
FIG. 2 is a side elevation along line 2—2 of FIG. 1.

As seen in the side view of FIG. 2 where two heat exchange tubes 30 are shown in shadow behind side wall 14, the tube sections extend substantially horizontally. Also shown in FIG. 2 is the exhaust path 46 from vertical duct 40, including a blower 48 located therealong to induce a draft in the heat exchange tubes. Baking chamber corner panel 24 includes three air outlet openings 50 therein, each of which is aligned with a corresponding axial fan 52. The axial fans 52 are located outside the baking chamber in a duct or ducts formed behind the corner panel 24, and an annular ring 51 may be provided about each opening 50 for air flow purposes. The axial fans 52 may be driven by respective low horsepower motors, such as ¼ horsepower or less, and the axis of each fan may be substantially horizontal. Baffles 55 are provided between vertically adjacent axial fans 52 to create a generally lateral flow path of air from each fan as shown by arrows 57. Baking chamber corner panel 16 includes a plurality of air inlet openings, including a plurality of vertically spaced primary air flow openings 54 and a plurality of vertically spaced secondary air flow openings 56, which are smaller in size than the primary air flow openings 54. In the illustrated embodiment two vertical rows of primary air flow openings 54 are provided and two corresponding vertical rows of secondary air flow openings 56 are provided. However, it is recognized that many variations are possible. A rotating mechanism 58 extends from the top of the baking chamber for receiving a rack 60 having multiple rows 62 of food product thereon, and rotating the rack 60 during the baking process.

Referring again to the top view of FIG. 1 where the arrows indicate the flow of cooking air through the oven when the axial fans 52 are operating, it is seen that in the illustrated embodiment cooking air flows generally horizontally through the heat exchanger section 28, through the air inlets in panel 16 into the baking chamber 12, and through the air outlets in panel 24 and back into the heat exchanger section 28. Referring to FIG. 2, in order to facilitate general horizontal air flow through the baking chamber 12, in one embodiment the air inlet openings 54 and 56 and the air outlet openings 50 may be relatively positioned such that an angle $\Phi$, relative to the horizontal, between any given air inlet opening and the most vertically near air outlet opening does not exceed 30°. In another embodiment the relative positioning of the air inlet openings 54 and 56 and the air outlet openings 50 may be set such that angle $\Phi$ does not exceed 20°. At the same time, in one embodiment, a relatively uniform air flow can be maintained in the baking chamber 12 by assuring that the air inlet openings 54 and 56 are distributed (i.e., the distance from the lowest opening lower edge to the highest opening highest edge) over at least 70% of the overall height of the baking chamber 12.

Also of note is that a substantial portion of air flow through the heat exchanger section 28 is along an axial length of the heat exchange tubes 30, particularly tube sections 34 and 36 in the illustrated embodiment, due to positioning of the air inlet openings in panel 16 and the air outlet openings in panel 24. In particular, the outlet openings 50 are positioned toward a first axial side of the plurality of heat exchange tubes 30 and the inlet openings 54 and 56 are positioned toward a second axial side of the plurality of heat exchange tubes 30 causing the air flow along the axial length of the tubes 30. More specifically, the outlet openings 50 and axial fans 52 are positioned in the front corner of the baking chamber 12 adjacent side wall 14 and the inlet openings 54 and 56 are positioned in the back corner of the baking chamber 12 adjacent the side wall 14. As the air flows across the surface of the tubes in the heat exchanger section, the air picks up heat from the tubes. In the illustrated embodiment, the heat exchange tubes are substantially horizontal and the air flow from the first axial side of the tubes toward the second axial side of the tubes is likewise generally horizontal, but it is recognized that other orientations of the tubes and air flow along the tubes are possible, including tubes and corresponding air flow that extend vertically, in which case one axial side of the tubes would be located toward a lower part of the oven and the other axial side of the tubes would be located toward an upper part of the oven.

Figure 3:
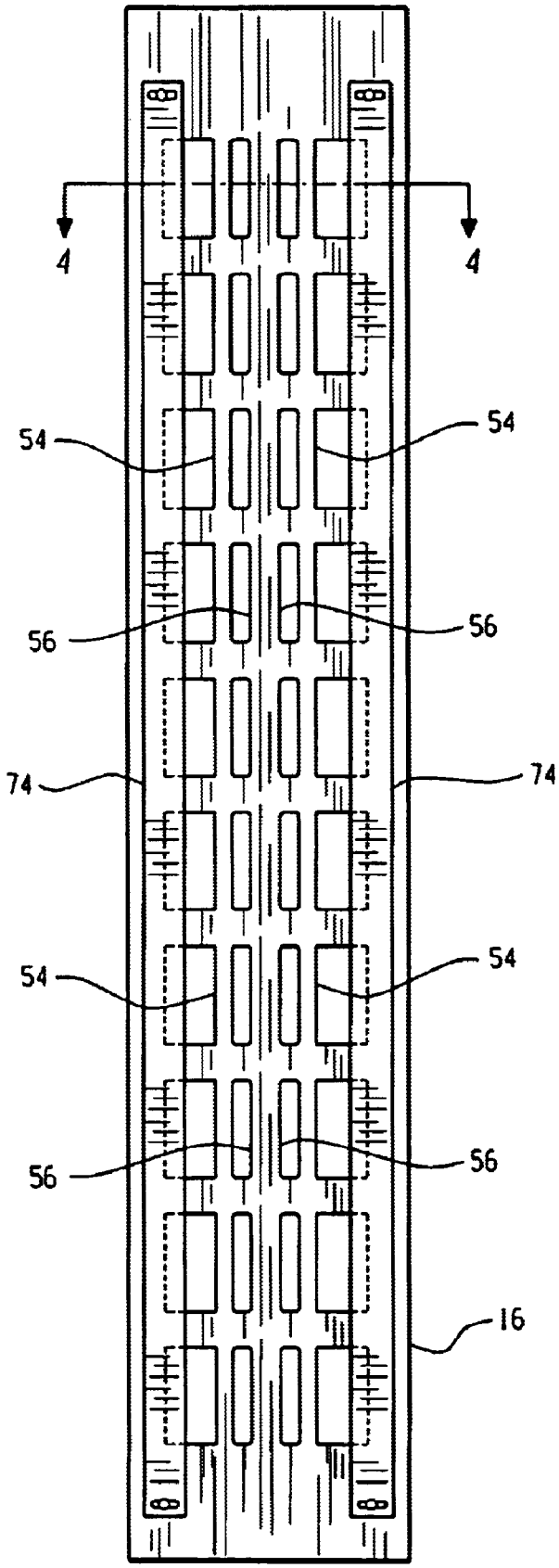
FIG. 3 is an elevation view of one corner panel of the oven of FIG. 1.
Figure 4:
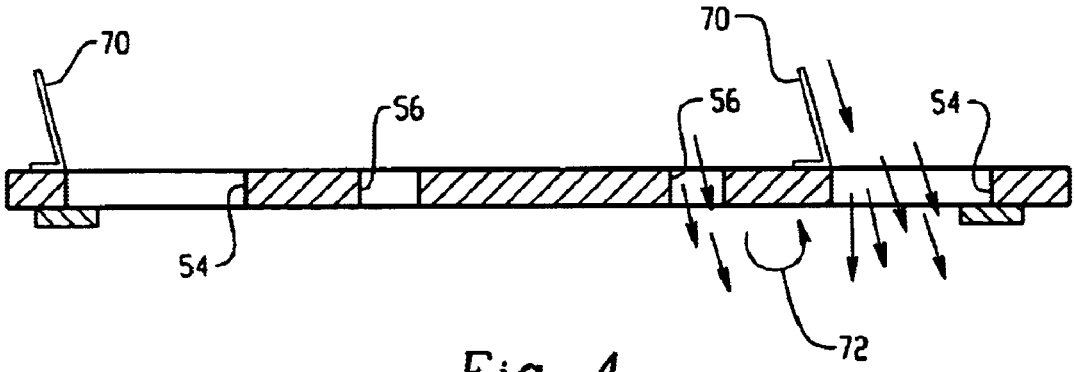
FIG. 4 is a top cross-section view along line 4—4 of FIG. 3.

Within the baking chamber 12, air flows in a generally looped fashion, from panel 16 to panel 24. The air speed and direction of heated air flowing from panel 16 is set to produce as uniform a flow of air through the entire chamber 12 as possible to provide the most even and consistent cooking conditions in all areas of the baking chamber 12. In this regard reference is made to FIGS. 3 and 4 showing the panel 16. As shown, the primary air flow openings 54 are larger in size than the secondary air flow openings 56. The primary air flow openings 54 include adjacent vanes 70 on the back side of the panel for causing the air flow to track the vain direction because the air stream tends to attach itself to the surface of the vanes 70. Because the secondary flow openings 56 are smaller than primary flow openings 54, the air flow through them will be less. This secondary air stream converges slightly for a short distance from the opening 56 and then spreads, losing air speed more rapidly than the stream of air from the primary flow openings/slots 54, creating eddies such as 72 that tend to pull the primary air stream in the direction of the eddies, widening the primary air stream to produce a more even distribution and mixing of heated air through the baking chamber 12. The panel 16 may include movable panels 74 to adjust the size of primary air flow inlet openings 54 by sliding the panels 74 more or less over the openings 54. These panels 74 can be adjusted during oven set up to obtain desired air flow.

As noted previously, as part of a typical baking operation steam may initially be introduced into the baking chamber 12. In this regard, a steam generator 80 is provided on behind corner wall panel 16, and may take the form of a mass of iron or steel of any suitable configuration, and an associated source of water. In the illustrated embodiment the steam generator is formed in a triangular configuration. The iron mass is heated by air that passes through open spaces in the mass, and when the source of water introduces water onto the mass the water quickly turns to steam. The steam enters chamber 12 through the panel 16.

Figure 5:
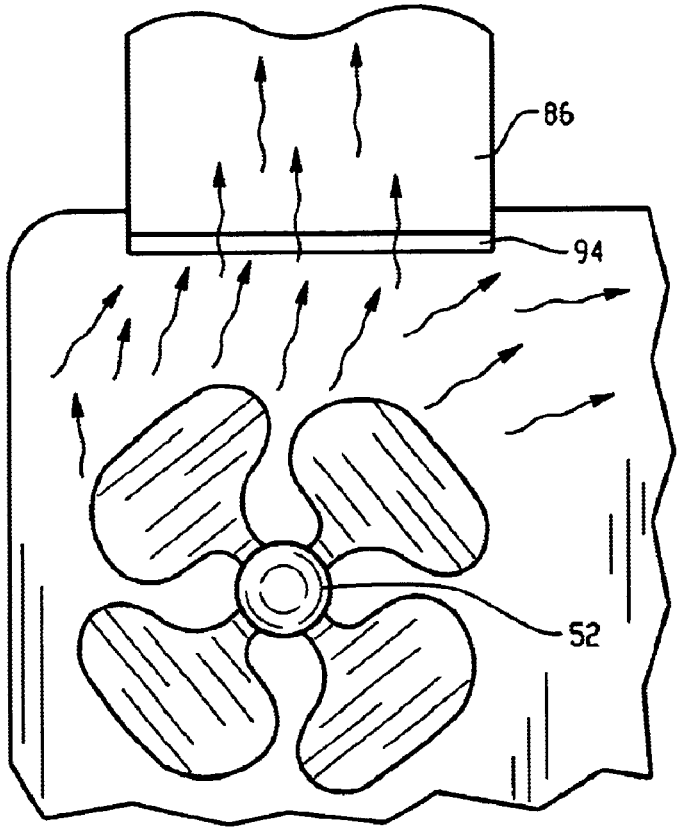
FIG. 5 is partial elevation of a top axial fan and associated vent path.

After the steaming period it is generally desirable to quickly expel the steam from the chamber 12. A passive, open air flow path 88 (FIG. 1) is generally neutral so that during normal baking minimal heat loss or cold air entry is experience through the opening 84. A vent path 86 (FIG. 5) for expelling air from the main cooking air flow path of the oven is also provided. The flow path 88 is in flow communication with a vertical duct 80 defined in part by corner panel 20, which has a plurality of vertically spaced openings 92 (FIG. 6) leading to the baking chamber 12 for vertically distributing ambient air into the baking chamber when desired. As shown in FIG. 5, the vent path 86 may be located above the top axial fan 52 and may also include a controllable shutter mechanism 94 for selectively opening and closing the path. Operation of the top axial fan 52 while the vent path 86 is opened actively pushes air out the vent opening as a result of the radial flow component produced by the top axial fan 52. Generally, to expel steam from the chamber 12, the vent path 86 would be opened to during rotation of adjacent axial fan 52 to cause steam to exit, and at that time air will enter through path 84, duct 88 and openings 92 into the chamber to replace the steam lost through the vent path 86. By providing a plurality of vertically spaced openings 92 in panel 20, the ambient air can be introduced into the baking chamber 12 on a relatively uniform basis along the height of the oven chamber.

Figure 6:
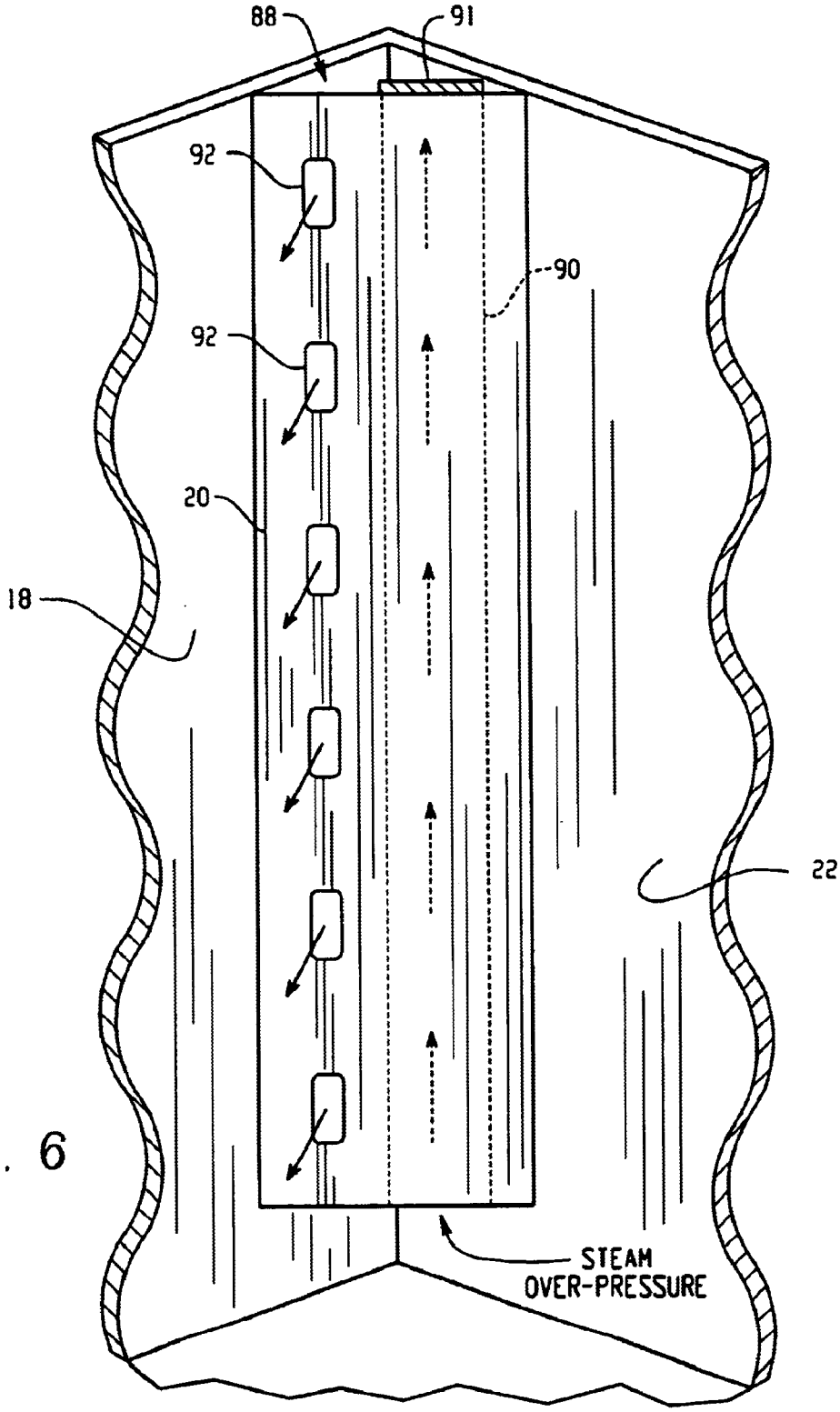
FIG. 6 is an elevation view of one corner panel of the oven of FIG. 1.
Figure 7A:
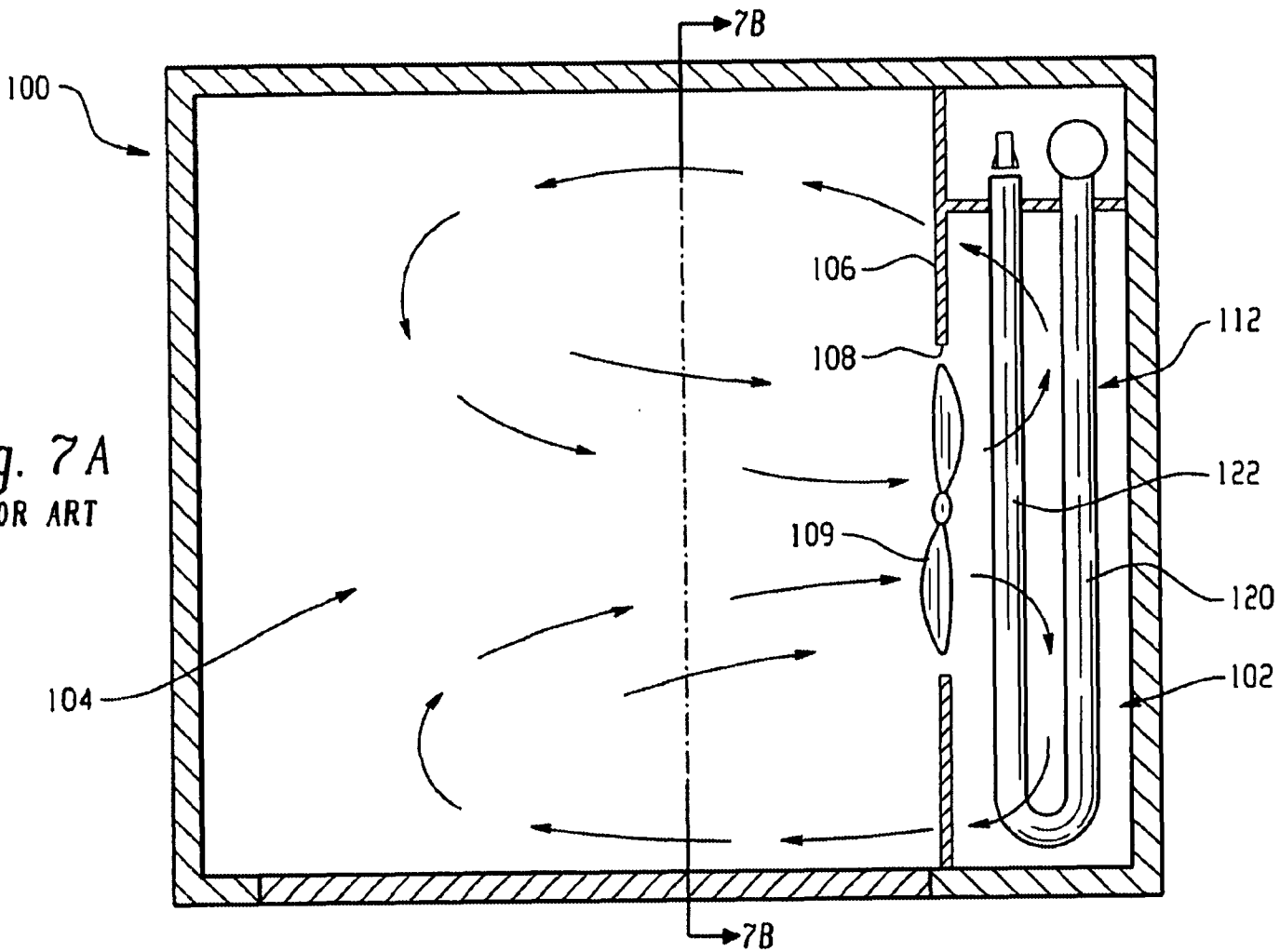
Fig. 7A PRIOR ART
FIG. 7A is a top plan view of a prior art rack oven.
Figure 7C:
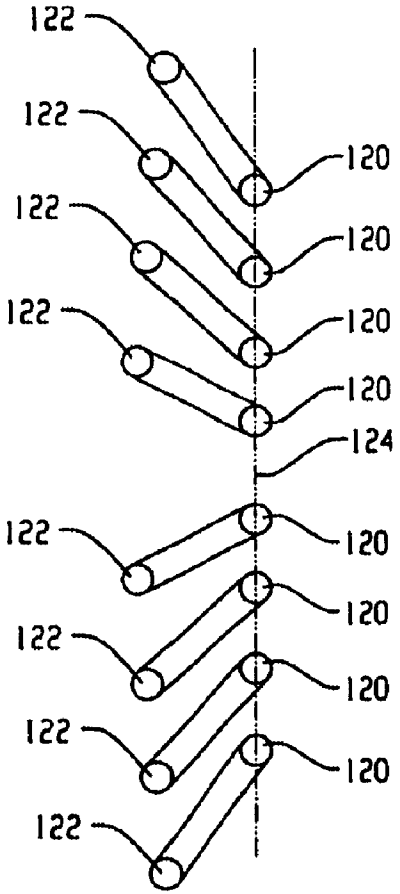
Fig. 7C PRIOR ART
FIG. 7C illustrates the progressively increasing angle of the U-shaped heat exchanges tubes used in the prior art oven of FIGS. 7A and 7B.
Figure 7B:
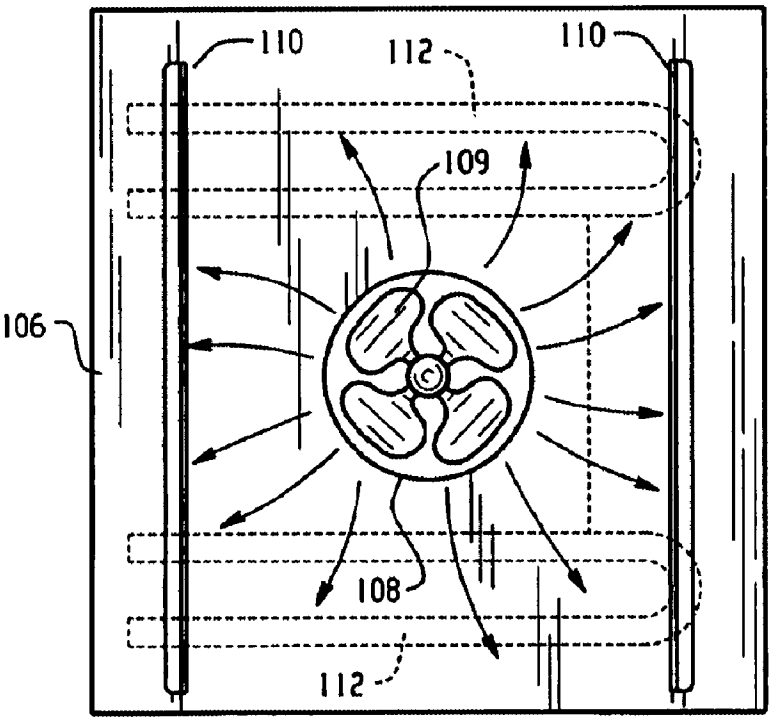
Fig. 7B PRIOR ART
FIG. 7B is a partial side view along line 7B—7B of FIG. 7A.

As best seen in FIG. 6, the corner panel 20 is spaced above the oven floor and is closed at the bottom, with the exception of an opening that leads to a large pipe 90 having a flapper 91 at the top thereof. When steam pressure within the oven becomes high enough, the flapper 91 is raised allowing the release of some of the steam/pressure to ambient atmosphere.

Regarding the vertically spaced axial fans 52, in one embodiment the fans may all rotate in the same direction (i.e., all clockwise or all counterclockwise when viewed from the perspective of FIG. 2). In another embodiment, air flow may be improved if one of the fans 52, such as the middle axial fan, rotates in a direction opposite the other two fans (i.e., when viewed from the perspective of FIG. 2, top and bottom fans clockwise and middle fan counterclockwise or top and bottom fans counterclockwise and middle fan clockwise). In the latter case the orientation of the fan blades of the middle fan would have to be different than that of the other two fans in order to assure that air is pulled in the proper direction through all openings 50 in panel 24.

It is to be clearly understood that the above description is intended by way of illustration and example only and is not intended to be taken by way of limitation. For example, an alternative oven construction could utilize a heat exchanger section having a plurality of resistive heating elements in place of the heat exchange tubes. Further, on another variation the air inlet from the heat exchanger section to the baking chamber might be located in either the right rear corner or right front corner (as viewed from FIG. 1), with appropriate air flow paths being provided behind chamber walls 18 and 22 as needed. In other embodiments the air outlet(s) from and air inlet(s) to the baking chamber could be located in baking chamber walls other than corner walls, and in some cases could be located on different parts of the same baking chamber wall. Other changes and modifications could be made, including both narrowing and broadening variations and modifications of the appended claims of this application.

What is claimed is:

1. A rack oven, comprising:

a baking chamber;

a door providing access to the baking chamber;

a steam generator for providing moisture-containing air to the baking chamber;

a heat exchanger section positioned outside the baking chamber and alongside a first wall of the baking chamber;

at least one air outlet positioned in a first corner panel of the baking chamber and in flow communication with the heat exchanger section, the first corner panel adjacent the first wall of the baking chamber;

at least one air inlet positioned in a second corner panel of the baking chamber and in flow communication with the heat exchanger section; and at least one blower positioned to circulate air through the oven, when the blower is operated air flows generally horizontally through the heat exchanger section, through the air inlet into the baking chamber, generally horizontally through the baking chamber, and through the air outlet back into the heat exchanger section.

2. The rack oven of claim 1 wherein the second corner panel is located adjacent the first wall of the baking chamber.

3. The rack oven of claim 1, further comprising:

a plurality of in-shot burners;

wherein the heat exchanger section comprises a plurality of heat exchange tubes;

wherein each in-shot burner of said plurality of in-shot burners is aligned for firing into a respective one of the heat exchange tubes.

4. The rack oven of claim 3 wherein the at least one air outlet comprises a plurality of vertically spaced openings and the at least one blower comprises a plurality of axial fans, each axial fan aligned with a respective one of the vertically spaced openings.

5. The rack oven of claim 4 wherein fan blades of at least one of the axial fans rotate in a direction opposite to fan blades of at least one other axial fan, and all fans pull air out of the baking chamber.

6. The rack oven of claim 4 wherein a baffle is provided between each pair of adjacent axial fans.

7. The rack oven of claim 4 wherein the plurality of axial fans include respective motors each rated at ¼ horsepower or less.

8. The rack oven of claim 4 wherein the plurality of axial fans consist of three axial fans.

9. The rack oven of claim 4 wherein an axis of each of the axial fans is arranged substantially horizontally.

10. The rack oven of claim 9, further comprising a vent positioned above a highest one of the axial fans, the vent including a controlled opening, wherein operation of the top axial fan while the vent is opened actively pushes air out the vent opening as a result of the radial flow component produced by the top axial fan.

11. The rack oven of claim 1, further comprising:

a mechanism for rotating a food product rack within the baking chamber.

12. A rack oven, comprising:

a baking chamber;

a door providing access to the baking chamber;

a steam generator for providing moisture-containing air to the baking chamber;

a heat exchanger section positioned outside the baking chamber and alongside a first wall of the baking chamber;

at least one air outlet positioned in a first corner of the baking chamber and in flow communication with the heat exchanger section, the first corner adjacent the first wall of the baking chamber;

at least one air inlet positioned in a second corner of the baking chamber and in flow communication with the heat exchanger section; and at least one blower positioned to circulate air through the oven, when the blower is operated air flows generally horizontally through the heat exchanger section, through the air inlet into the baking chamber, generally horizontally through the baking chamber, and through the air outlet back into the heat exchanger section;

wherein the at least one air inlet comprises including a plurality of vertically spaced primary air flow openings and a plurality of vertically spaced secondary air flow openings smaller in size than the primary air flow openings, air flow through the secondary air flow openings creating eddies that affect an air stream exiting the primary air flow openings.

13. The rack oven of claim 12 wherein the primary air flow openings include a fixed vane at one side thereof and outside the baking chamber, and the primary air flow openings further include a movable shutter for adjusting size of the primary air flow openings.

14. A rack oven, comprising:

a baking chamber;

a door providing access to the baking chamber;

a steam generator for providing moisture-containing air to the baking chamber;

a heat exchanger section positioned outside the baking chamber and alongside a first wall of the baking chamber;

at least one air outlet positioned in a first corner of the baking chamber and in flow communication with the heat exchanger section, the first corner adjacent the first wall of the baking chamber;

at least one air inlet positioned in a second corner of the baking chamber and in flow communication with the heat exchanger section; and at least one blower positioned to circulate air through the oven, when the blower is operated air flows generally horizontally through the heat exchanger section, through the air inlet into the baking chamber, generally horizontally through the baking chamber, and through the air outlet back into the heat exchanger section; and an air flow path open to receive ambient air from outside the oven, the air flow path in flow communication with a plurality of vertically spaced openings leading to the baking chamber for vertically distributing ambient air into the baking chamber.

15. The rack oven of claim 14 wherein the vertically spaced openings are positioned in a third corner of the baking chamber.

16. A rack oven, comprising:

a baking chamber;

a door providing access to the baking chamber;

a steam generator for providing moisture-containing air to the baking chamber;

a heat exchanger section positioned outside the baking chamber and alongside a first wall of the baking chamber;

at least one air outlet positioned in a first corner of the baking chamber and in flow communication with the heat exchanger section, the first corner adjacent the first wall of the baking chamber;

at least one air inlet positioned in a second corner of the baking chamber and in flow communication with the heat exchanger section; and at least one blower positioned to circulate air through the oven, when the blower is operated air flows generally horizontally through the heat exchanger section, through the air inlet into the baking chamber, generally horizontally through the baking chamber, and through the air outlet back into the heat exchanger section; and wherein the at least one air inlet comprises a plurality of vertically distributed air inlets and the at least one air outlet comprises a plurality of vertically distributed air outlets, and wherein the air inlets and the air outlets are relatively positioned such that an angle Φ, relative to horizontal, between any given air inlet and the most vertically near air outlet does not exceed 30°.

17. The rack oven of claim 16 wherein the angle Φ does not exceed 20°.

18. The rack oven of claim 16 wherein the air inlets are distributed over at least 70% of an overall height of the baking chamber.

19. An oven, comprising:

a baking chamber including an air outlet for passing air out of the baking chamber during baking and an air inlet for passing air into the baking chamber during baking;

a door providing access to the baking chamber;

a plurality of in-shot burners;

a heat exchanger section positioned outside the baking chamber, the heat exchanger section comprising a plurality of heat exchange tubes, wherein each in-shot burner of said plurality of in-shot burners is aligned for firing into a respective one of the heat exchange tubes;

an air outlet flow path extending from the air outlet to the heat exchanger section and introducing air into the heat exchanger section toward a first axial side of the plurality of heat exchange tubes;

an air inlet flow path extending from the heat exchanger section to the air inlet causing air to exit the heat exchanger section toward a second axial side of the plurality of heat exchange tubes; and at least one blower positioned for circulating air through the heat exchanger section, through the air inlet into the baking chamber, and through the air outlet back into the heat exchanger section, whereby air flows through the heat exchanger section from the first axial side of the heat exchange tubes, substantially along the axial length of the heat exchange tubes and to the second axial side of the heat exchange tubes;

a mechanism for rotating a food product rack within the baking chamber;

a steam generator for providing steam for condensation onto food product within the chamber.

20. The oven of claim 19 wherein each of the plurality of heat exchange tubes comprises a multi pass tube having at least two parallel tube sections connected by a bend.

21. The oven of claim 19 wherein the first axial side of the heat exchange tubes is positioned toward the plurality of in-shot burners.

22. The oven of claim 19 wherein the heat exchange tubes extend substantially horizontally.

23. The rack oven of claim 19, further comprising a steam overpressure outlet for allowing steam to exit the chamber.

24. The rack oven of claim 19 wherein a top located exhaust path is provided to receive combustion gases from the heat exchange tubes.

25. An oven, comprising:

a baking chamber including an air outlet for passing air out of the baking chamber during baking and an air inlet for passing air into the baking chamber during baking;

a door providing access to the baking chamber;

a plurality of in-shot burners;

a heat exchanger section positioned outside the baking chamber, the heat exchanger section comprising a plurality of heat exchange tubes, wherein each in-shot burner of said plurality of in-shot burners is aligned for firing into a respective one of the heat exchange tubes;

an air outlet flow path extending from the air outlet to the heat exchanger section and introducing air into the heat exchanger section toward a first axial side of the plurality of heat exchange tubes;

an air inlet flow oath extending from the heat exchanger section to the air inlet causing air to exit the heat exchanger section toward a second axial side of the plurality of heat exchange tubes; and at least one blower positioned for circulating air through the heat exchanger section, through the air inlet into the baking chamber, and through the air outlet back into the heat exchanger section, whereby air flows through the heat exchanger section from the first axial side of the heat exchange tubes to the second axial side of the heat exchange tubes; and wherein each of the plurality of heat exchange tubes comprises a multi pass tube having at least two parallel tube sections connected by a bend, wherein the parallel tube sections extend substantially horizontally.

26. An oven, comprising:

a baking chamber;

a door providing access to the baking chamber;

a heat exchanger section positioned outside the baking chamber; a plurality of vertically spaced air outlet openings in a baking chamber wall, each opening aligned with a respective, adjacent axial fan, the openings in flow communication with the heat exchanger section;

a plurality of air inlet openings in a baking chamber wall and in flow communication with the heat exchanger section for passing heated air from the heat exchanger section to the baking chamber;

when the axial fans are operated air flows generally horizontally through the heat exchanger section, through the air inlet into the baking chamber, generally horizontally through the baking chamber, and through the air outlet openings and back into the heat exchanger section.

27. The oven of claim 26 wherein the axial fans are positioned to the outside of the baking chamber.

28. The oven of claim 26, further comprising:

a plurality of in-shot burners;

wherein the heat exchanger section comprises a plurality of heat exchange tubes, each in-shot burner of said plurality of in-shot burners aligned for firing into a respective one of the heat exchange tubes.

29. The oven of claim 26 wherein the plurality of axial fans include respective motors each rated at ¼ horsepower or less.

30. The oven of claim 26, further comprising:

a mechanism for rotating a food product rack within the baking chamber; and a steam generator for introducing steam to the baking chamber.

31. The oven of claim 26, wherein the air inlet openings and the air outlet openings are relatively positioned such that an angle Φ, relative to horizontal, between any given air inlet opening and the most vertically near air outlet opening does not exceed 20°.

32. The oven of claim 31 wherein the air inlet openings are distributed over at least 70% of an overall height of the baking chamber.

* * * * *

UNITED STATES PATENT AND TRADEMARK OFFICE

CERTIFICATE OF CORRECTION

PATENT NO. : 6,854,457 B2
DATED : February 15, 2005
INVENTOR(S) : Jiri Rabas et al.

It is certified that error appears in the above-identified patent and that said Letters Patent is hereby corrected as shown below:

Column 10,
Line 8, change “oath” to -- path --.

Signed and Sealed this

Tenth Day of May, 2005

JON W. DUDAS
*Director of the United States Patent and Trademark Office*